US008968025B2

(12) United States Patent
Shaw

(10) Patent No.: US 8,968,025 B2
(45) Date of Patent: Mar. 3, 2015

(54) COUPLING CONTINUITY CONNECTOR

(71) Applicant: Glen David Shaw, Conway, AR (US)

(72) Inventor: Glen David Shaw, Conway, AR (US)

( * ) Notice: Subject to any disclaimer, the term of this patent is extended or adjusted under 35 U.S.C. 154(b) by 73 days.

(21) Appl. No.: 13/941,317

(22) Filed: Jul. 12, 2013

(65) Prior Publication Data

US 2013/0295793 A1 Nov. 7, 2013

Related U.S. Application Data

(63) Continuation-in-part of application No. 13/589,666, filed on Aug. 20, 2012, which is a continuation-in-part of application No. 13/374,378, filed on Dec. 27, 2011, now Pat. No. 8,636,541.

(51) Int. Cl.

| | |
|---|---|
| ***H01R 9/05*** | (2006.01) |
| ***H01R 13/24*** | (2006.01) |
| ***H01R 13/622*** | (2006.01) |
| *H01R 13/17* | (2006.01) |

(52) U.S. Cl.

CPC ..... *H01R 9/0521* (2013.01); *H01R 13/2421* (2013.01); *H01R 13/622* (2013.01); *H01R 13/17* (2013.01)

USPC ..... 439/578

(58) Field of Classification Search

CPC ..... H01R 24/40

USPC ..... 439/578, 583–585

See application file for complete search history.

(56) References Cited

U.S. PATENT DOCUMENTS

| | | | | |
|---|---|---|---|---|
| 3,823,292 | A | 7/1974 | Murata | |
| 4,462,033 | A | 7/1984 | Grashow | |
| 4,824,400 | A | 4/1989 | Spinner | |
| 4,857,015 | A | 8/1989 | Michaels | |
| 4,915,651 | A | 4/1990 | Bout | |
| 4,934,666 | A | 6/1990 | Balsells | |
| 5,061,191 | A | 10/1991 | Casciotti | |
| 5,083,943 | A | 1/1992 | Tarrant | |
| 5,310,359 | A | 5/1994 | Chadbourne | |
| 5,454,735 | A | 10/1995 | Nelson | |
| 5,470,257 | A | 11/1995 | Szegda | |
| 5,795,188 | A | 8/1998 | Harwath | |
| 5,938,474 | A | 8/1999 | Nelson | |
| 6,666,690 | B2 | 12/2003 | Ishizuka et al. | |
| 6,781,390 | B2 | 8/2004 | Kazama | |
| 6,873,168 | B2 | 3/2005 | Kazama | |
| 6,908,337 | B1 | 6/2005 | Li | |
| 7,011,547 | B1 * | 3/2006 | Wu | 439/584 |
| 7,131,867 | B1 | 11/2006 | Foster | |
| 7,513,795 | B1 * | 4/2009 | Shaw | 439/578 |
| 7,566,236 | B2 * | 7/2009 | Malloy et al. | 439/321 |
| 7,727,013 | B1 | 6/2010 | Paynter | |
| 7,828,595 | B2 * | 11/2010 | Mathews | 439/578 |
| 7,833,053 | B2 * | 11/2010 | Mathews | 439/578 |
| 7,841,896 | B2 * | 11/2010 | Shaw et al. | 439/578 |
| 7,845,976 | B2 * | 12/2010 | Mathews | 439/578 |
| 7,850,487 | B1 * | 12/2010 | Wei | 439/578 |
| 7,892,005 | B2 * | 2/2011 | Haube | 439/321 |

(Continued)

FOREIGN PATENT DOCUMENTS

| | | |
|---|---|---|
| WO | 2010046242 A2 | 4/2010 |
| WO | WO 2010/046242 | 4/2010 |

*Primary Examiner* — Ross Gushi

(74) *Attorney, Agent, or Firm* — Paul D. Chancellor; Ocean Law

(57) ABSTRACT

A coaxial cable connector including a continuity element extending between a nut shroud and a body base.

8 Claims, 11 Drawing Sheets

(56) References Cited

U.S. PATENT DOCUMENTS 7,950,958 B2 * 5/2011 Mathews ..... 439/578
8,029,315 B2 * 10/2011 Purdy et al. ..... 439/578
8,062,063 B2 * 11/2011 Malloy et al. ..... 439/578
8,062,064 B2 * 11/2011 Rodrigues et al. ..... 439/578
8,113,875 B2 * 2/2012 Malloy et al. ..... 439/578
8,157,589 B2 * 4/2012 Krenceski et al. ..... 439/578
8,167,636 B1 * 5/2012 Montena ..... 439/322
8,192,237 B2 * 6/2012 Purdy et al. ..... 439/792
8,231,412 B2 * 7/2012 Paglia et al. ..... 439/607.17
8,282,429 B2 10/2012 Glick
8,287,310 B2 * 10/2012 Burris et al. ..... 439/578
8,287,320 B2 * 10/2012 Purdy et al. ..... 439/792
RE43,832 E * 11/2012 Malloy et al. ..... 439/321
8,323,060 B2 * 12/2012 Purdy et al. ..... 439/792
8,328,577 B1 * 12/2012 Lu ..... 439/578
8,337,229 B2 * 12/2012 Montena ..... 439/322
8,366,481 B2 * 2/2013 Ehret et al. ..... 439/578
8,393,919 B2 3/2013 Islam
8,469,739 B2 * 6/2013 Rodrigues et al. ..... 439/578
8,491,334 B2 * 7/2013 Rodrigues ..... 439/584
8,506,325 B2 * 8/2013 Malloy et al. ..... 439/578
8,529,279 B2 * 9/2013 Montena ..... 439/322
8,550,835 B2 * 10/2013 Montena ..... 439/322
8,556,654 B2 * 10/2013 Chastain et al. ..... 439/578
8,556,656 B2 * 10/2013 Thomas et al. ..... 439/584
2003/0186583 A1 * 10/2003 Yeh ..... 439/585
2006/0110977 A1 * 5/2006 Matthews ..... 439/578
2007/0049113 A1 * 3/2007 Rodrigues et al. ..... 439/578
2007/0087628 A1 * 4/2007 Rodrigues et al. ..... 439/585
2007/0093127 A1 * 4/2007 Thomas et al. ..... 439/578
2007/0093128 A1 * 4/2007 Thomas et al. ..... 439/578
2007/0281542 A1 * 12/2007 Palinkas et al. ..... 439/585
2008/0102696 A1 * 5/2008 Montena ..... 439/578
2008/0248689 A1 * 10/2008 Montena ..... 439/583
2008/0311790 A1 * 12/2008 Malloy et al. ..... 439/583
2009/0053931 A1 * 2/2009 Islam ..... 439/578
2009/0170360 A1 * 7/2009 Shaw et al. ..... 439/277
2009/0176396 A1 * 7/2009 Mathews ..... 439/271
2009/0176407 A1 * 7/2009 Shaw ..... 439/584
2009/0181575 A1 * 7/2009 Hung ..... 439/583
2009/0186505 A1 * 7/2009 Mathews ..... 439/271
2009/0203256 A1 * 8/2009 Mathews ..... 439/583
2010/0081321 A1 * 4/2010 Malloy et al. ..... 439/578
2010/0081322 A1 * 4/2010 Malloy et al. ..... 439/578
2010/0112855 A1 * 5/2010 Paynter et al. ..... 439/584
2010/0130061 A1 * 5/2010 Snyder et al. ..... 439/584
2010/0216339 A1 * 8/2010 Burris et al. ..... 439/578
2010/0255720 A1 * 10/2010 Radzik et al. ..... 439/578
2010/0255721 A1 * 10/2010 Purdy et al. ..... 439/583
2010/0273351 A1 * 10/2010 Holliday ..... 439/584
2010/0297871 A1 * 11/2010 Haube ..... 439/489
2010/0297875 A1 * 11/2010 Purdy et al. ..... 439/578
2011/0008998 A1 * 1/2011 Low et al. ..... 439/578
2011/0021072 A1 * 1/2011 Purdy ..... 439/578
2011/0053413 A1 * 3/2011 Mathews ..... 439/578
2011/0065317 A1 * 3/2011 Shaw et al. ..... 439/578
2011/0111623 A1 * 5/2011 Burris et al. ..... 439/578
2011/0117774 A1 * 5/2011 Malloy et al. ..... 439/578
2011/0117776 A1 * 5/2011 Burris et al. ..... 439/578
2011/0143567 A1 * 6/2011 Purdy et al. ..... 439/277
2011/0143586 A1 * 6/2011 Ehret et al. ..... 439/584
2011/0180177 A1 * 7/2011 Shaw ..... 141/1
2011/0230089 A1 * 9/2011 Amidon et al. ..... 439/578
2011/0230091 A1 * 9/2011 Krenceski et al. ..... 439/578
2011/0250789 A1 * 10/2011 Burris et al. ..... 439/578
2011/0312199 A1 * 12/2011 Alrutz et al. ..... 439/188
2012/0021642 A1 * 1/2012 Zraik ..... 439/578
2012/0040537 A1 * 2/2012 Burris ..... 439/11
2012/0045933 A1 * 2/2012 Youtsey ..... 439/578
2012/0064763 A1 * 3/2012 Radzik et al. ..... 439/578
2012/0064764 A1 * 3/2012 Islam ..... 439/578
2012/0064767 A1 * 3/2012 Islam et al. ..... 439/583
2012/0064768 A1 * 3/2012 Islam et al. ..... 439/585
2012/0083154 A1 * 4/2012 Thomas et al. ..... 439/585
2012/0094530 A1 * 4/2012 Montena ..... 439/578
2012/0108104 A1 * 5/2012 Snyder et al. ..... 439/584
2012/0122329 A1 * 5/2012 Montena ..... 439/271
2012/0129387 A1 * 5/2012 Holland et al. ..... 439/578
2012/0142215 A1 * 6/2012 Rodrigues et al. ..... 439/578
2012/0171894 A1 * 7/2012 Malloy et al. ..... 439/578
2012/0178289 A1 * 7/2012 Holliday ..... 439/585
2012/0196476 A1 * 8/2012 Haberek et al. ..... 439/578
2012/0202378 A1 * 8/2012 Krenceski et al. ..... 439/578
2012/0208407 A1 8/2012 Leon
2012/0252263 A1 * 10/2012 Ehret et al. ..... 439/578
2012/0270428 A1 * 10/2012 Purdy et al. ..... 439/277
2013/0012063 A1 * 1/2013 Thomas et al. ..... 439/578
2013/0023151 A1 1/2013 Holliday
2013/0045627 A1 * 2/2013 Purdy ..... 439/578
2013/0065433 A1 * 3/2013 Burris ..... 439/578
2013/0072057 A1 * 3/2013 Burris ..... 439/578
2013/0102188 A1 * 4/2013 Montena ..... 439/578
2013/0102189 A1 * 4/2013 Montena ..... 439/578
2013/0115795 A1 * 5/2013 Ehret et al. ..... 439/274
2013/0164962 A1 * 6/2013 Shaw ..... 439/320
2013/0164975 A1 * 6/2013 Blake et al. ..... 439/578
2013/0164976 A1 * 6/2013 Chastain et al. ..... 439/583
2013/0171869 A1 * 7/2013 Chastain et al. ..... 439/583
2013/0171870 A1 * 7/2013 Chastain et al. ..... 439/583
2013/0183857 A1 * 7/2013 Ehret et al. ..... 439/578
2013/0237089 A1 * 9/2013 Lu ..... 439/578
2013/0295793 A1 * 11/2013 Shaw ..... 439/583

* cited by examiner

COUPLING CONTINUITY CONNECTOR

PRIORITY AND INCORPORATION BY REFERENCE

This application is a continuation in part of U.S. patent application Ser. No. 13/589,666 filed Aug. 20, 2012 which is a continuation in part of U.S. patent application Ser. No. 13/374,378 filed Dec. 27, 2011. Incorporated herein, in their entireties and for all purposes, are the disclosures of: U.S. patent application Ser. No. 13/589,666 filed Aug. 20, 2012 and Ser. No. 13/374,378 filed Dec. 27, 2011; and, U.S. Pat. No. 7,841,896 B1 which issued from U.S. patent application Ser. No. 12/380,327 filed Feb. 26, 2009.

BACKGROUND OF THE INVENTION

Coaxial cable connectors are well-known in various applications including those of the satellite and cable television industry. Coaxial cable connectors including F-Type connectors used in consumer applications such as cable and satellite cable connectors are a source of service calls when service is interrupted by lost and/or intermittent coaxial cable connections typically involving a junction between a male F-type connector terminating a coaxial cable and a female F-type port located on related equipment.

1. Field of Invention

This invention relates to the electromechanical arts. In particular, the invention provides an electrical connector suitable for terminating a coaxial cable having a center conductor and a ground conductor surrounding the center conductor.

2. Discussion of the Related Art

Coaxial cable connectors include variants designed to improve electrical continuity under extenuating circumstances. Some of these continuity improving connectors are connectors designed to simulate tight mechanical engagement of male and female connectors. Others are designed as electrically conductive bridges between conductive parts.

SUMMARY OF THE INVENTION

The present invention provides coaxial cable connectors such as a male F-Type coaxial cable connector. Various embodiments described herein include features for improving electrical continuity.

In an embodiment, a coaxial cable connector comprises: a coupling having a forward mouth and a trailing socket; a body coaxially arranged with respect to the coupling; the body having a base and a groove in a periphery of the base; a coil spring seated in the groove of the base and the base inserted in the socket of the coupling; the base and a socket interior surface spaced apart and defining a circumferential gap; the spring having at least one peak including a coil of a peak diameter; flanking spring portions to either side of the peak; the flanking spring portions having coils of one or more diameters no one of which is as large as the peak diameter; spring coils adjacent to the peak diameter coil contained within the groove; and, the peak diameter coil extending from the groove and contacting the socket interior surface.

BRIEF DESCRIPTION OF THE DRAWINGS

The present invention is described with reference to the accompanying figures. These figures, incorporated herein and forming part of the specification, illustrate embodiments of the present invention and, together with the description, further serve to explain the principles of the invention and to enable a person skilled in the relevant art to make and use the invention.

DETAILED DESCRIPTION OF THE PREFERRED EMBODIMENTS

The disclosure provided in the following pages describes examples of some embodiments of the invention. The designs, figures, and descriptions are non-limiting examples of certain embodiments of the invention. For example, other embodiments of the disclosed device may or may not include the features described herein. Moreover, disclosed advantages and benefits may apply to only certain embodiments of the invention and should not be used to limit the disclosed inventions.

As used herein, coupled means directly or indirectly connected by a suitable means known to persons of ordinary skill in the art. Coupled items may include interposed features such as, for example, A is coupled to C via B. Unless otherwise stated, the type of coupling, whether it be mechanical, electrical, fluid, optical, radiation, or other is provided by the context in which the term is used.

Figure 1A:
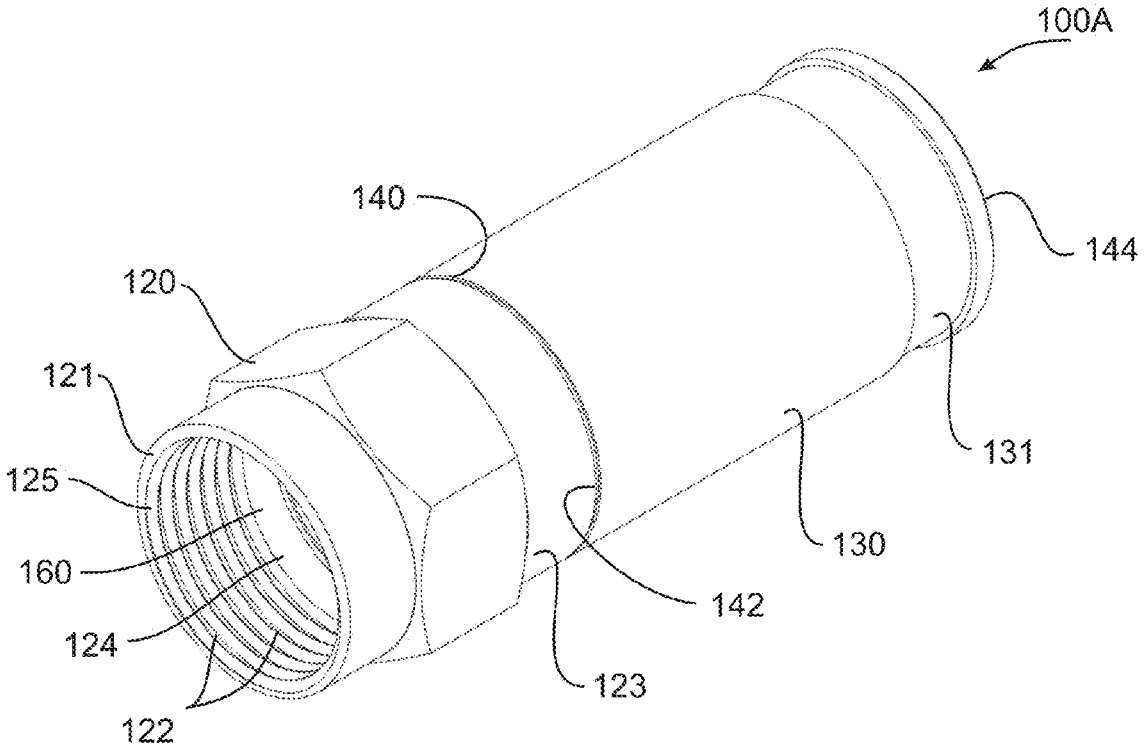
FIGS. 1A, B show perspective views of a male, F-type coaxial cable connector in accordance with the present invention.

FIG. 1A shows a perspective view of an F-type coaxial cable connector 100A. As seen, the connector includes a coupling such as a nut 120 that is adjacent to a sleeve-like portion such as an end cap or sleeve 130. As is further described below, relative motion between the end cap, nut, and underlying connector parts serves to fix the connector to a coaxial cable inserted in the connector. While embodiments of the present invention are not limited to particular connector types, connector attributes (male/female), or methods of cable/connector affixation, the disclosure of applicant's U.S. Pat. No. 7,841,896 B1 provides some illustrative examples of connectors such as male F-Type connectors, connector affixations, and coaxial cables used therewith.

The nut 120 has a front end 121 near a mouth 125 leading to a central chamber 124. Visible in the central chamber is a post flange 160 similar to those discussed below. Adjacent to the nut mouth are nut internal threads 122 for affixing the nut to a mating female coaxial connector. Near a nut rear end 140, the nut includes a shroud or socket 123.

As shown, the connector end cap 130 can be located adjacent to the nut 120. Here, an end cap front end 142 is adjacent to the socket 123. Generally opposed to the end cap front end is an end cap rear end 144. Some embodiments include an external end cap groove 131 encircling a periphery of the end cap near the rear end. In various embodiments, groove functions include seating a circular band such as a circular elastomeric band and/or aiding in one or more of identification, assembly, and use of the connector 100A.

Figure 1B:
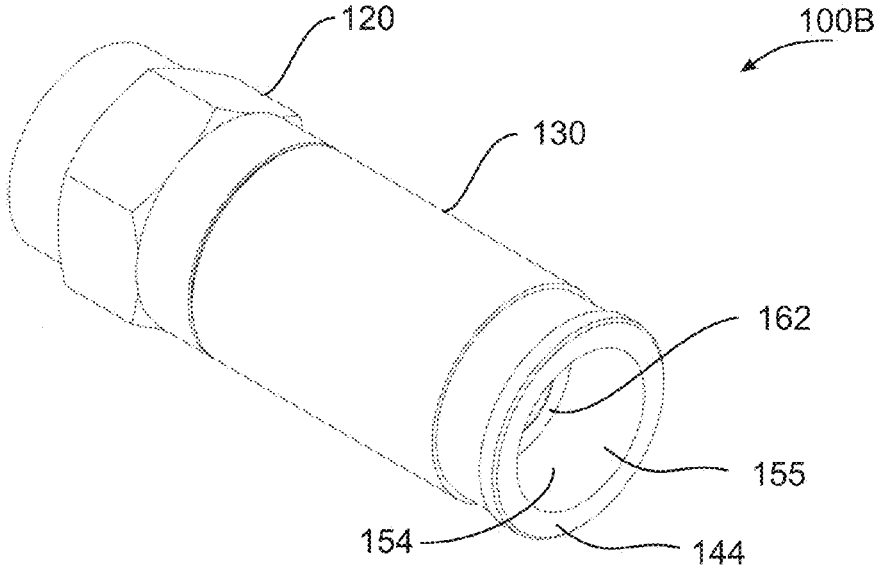

FIG. 1B shows a perspective view of the connector of FIG. 1A 100B. The nut 120 is shown adjacent to the end cap 130 and the rear end 144 of the end cap is turned to show the end cap mouth 155 leading to a central chamber 154. Visible in the central chamber is a post end 162 similar to those discussed below.

Figure 2A:
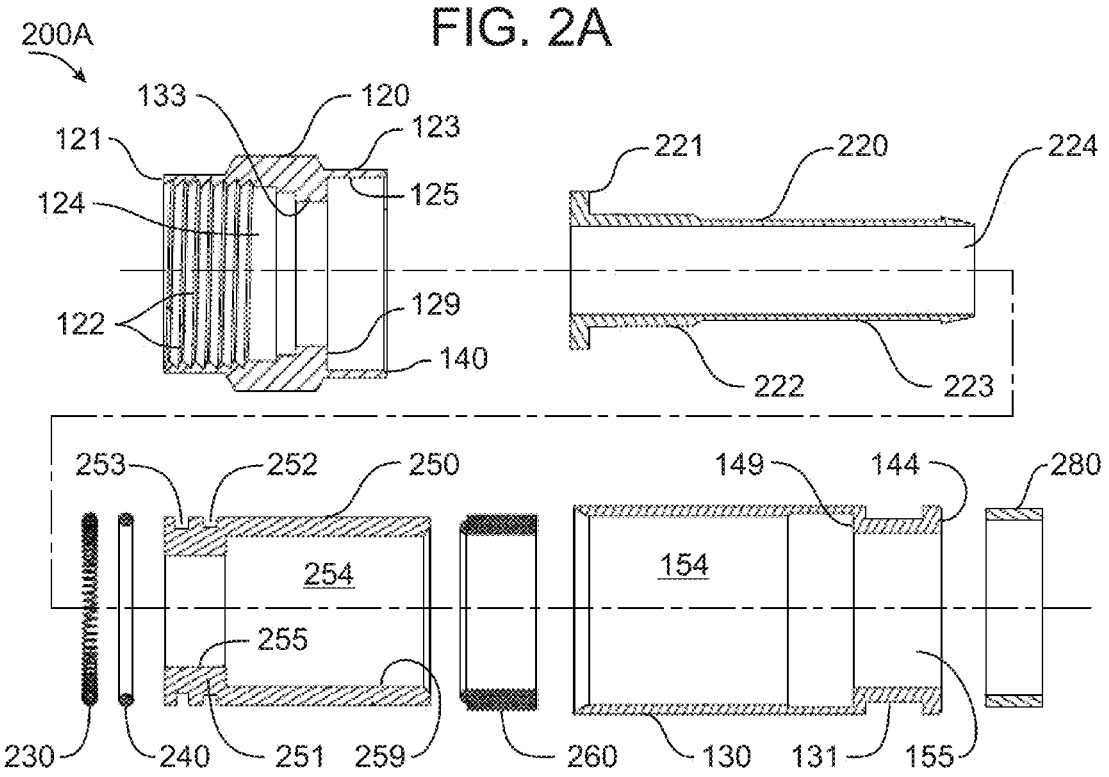
FIGS. 2A, B show exploded views of the connector of FIG. 1A above.
Figure 2B:
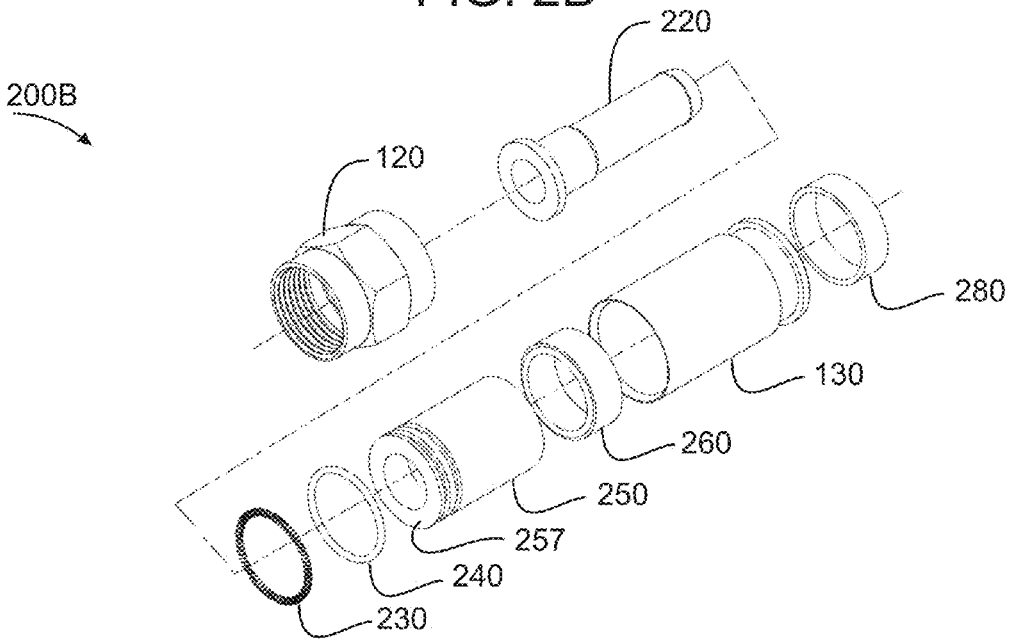

FIGS. 2A, B show a cross-sectional exploded view of a connector assembly similar to the connector of FIG. 1A 200A, 200B. Structural connector parts include the nut 120, a post such as a tubular post 220, a body such as a cylindrical body 250, and a sleeve or end cap 130. Used in conjunction with these structural parts is a group of fitted parts including one or more of a body mounted continuity member such as a spring 230, a body mounted ring such as an O-Ring 240, a coaxial cable encircling ring such as a dual diameter ring 260, and an end cap encircling ring such as an end cap band 280.

Spring materials include any of those known by skilled artisans to be suitable including resilient electrical conductors. Useful metals and/or their alloys include iron, steel, copper, nickel, beryllium, and the like. In an embodiment, the spring is made from a stainless steel and in an embodiment the spring is made from an alloy comprising beryllium and/or copper. In some embodiments, the spring is coated as with gold or another material which may be selected to reduce rubbing friction between the spring and a contacting part such as a coupling.

The post 220 rotatably couples with a coupling such as a nut 120 and fixedly couples with the body 250. In particular, embodiments provide an inwardly directed rim of the nut 133 that is forward of the socket 123. The rim engages a post end flange 221 to provide the rotatable nut/post coupling. A post shank 223 is configured to tightly engage an inwardly directed body collar 255 of a body base 251. In some embodiments, the post portion engaging the collar is a thickened or amended portion of the tubular post shank forming a post shank shoulder 222.

Mentioned above are the continuity member 230 and body mounted ring 240. Each of these fitments encircles the body base 251. In particular, embodiments provide adjacent body base grooves such as forward 253 and trailing 252 body grooves for seating the continuity member and ring. In some embodiments, the continuity member is in the forward groove while the ring is in the rear groove. And, in some embodiments the continuity member is in the rear groove while the ring is in the forward groove.

Embodiments of the connector provide an assembly wherein the dual diameter ring is a seal and/or a coaxial cable fixing member. During assembly of the connector to a coaxial cable, the seal is pushed forward by an internal annular shoulder 149 of the end cap 130. Configured to be forced into the central chamber 254 of the body 250, movement of the end cap 130 onto the body results in the seal being pushed into the body central chamber such that it becomes wedged between an inserted coaxial cable and an internal surface 259 of the base.

Figure 3A:
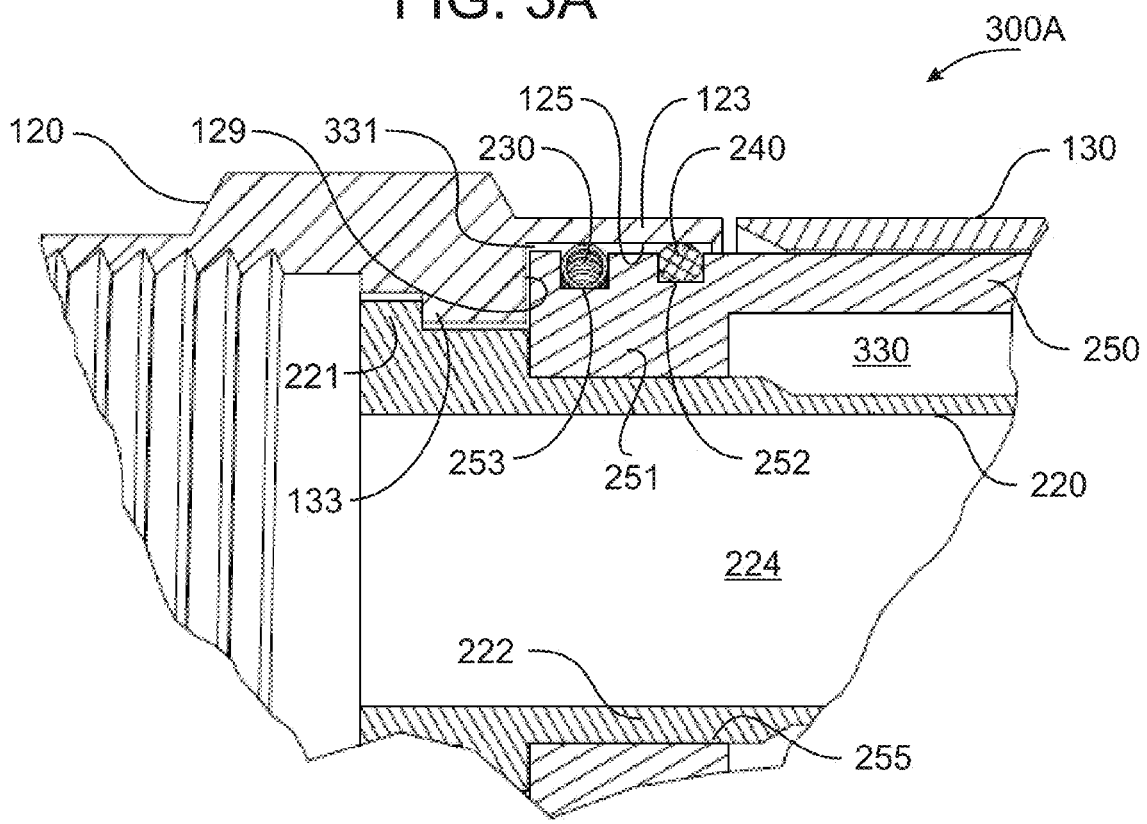
FIG. 3A shows an enlarged cross-sectional view of a coupling end of the connector of FIG. 1A above.

FIG. 3A shows an assembled connector partial cross section 300A. The nut 120 is rotatably engaged with the post 220 via the post flange 221 and the nut inwardly directed rim 133 while the body 250 is fixedly engaged with the post via post shank portion 222 and the body collar 255. In a slidably engaged arrangement, the end cap 130 is fitted over the body 250 for providing relative motion therebeteween.

Note that in FIG. 3A the end cap 130 is shown in near abutment with the nut 120. Although this is the position of the end cap typically following installation of the connector on a coaxial cable, no coaxial cable is show for clarity. Were a coaxial cable shown, its center conductor and surrounding dielectric would be shown inserted in the central chamber 224 of the post 220 and its outer conductor and jacket would be shown inserted in the annular chamber 330 formed between the body 250 and the post 220.

In the embodiment shown, fitments engaging the base 251 of the connector body 250 include a spring such as a coil spring 230 fitted into the base forward groove 253 and a ring such as an O-Ring 240 fitted into the base rear groove 252. As seen, the spring and the ring project from respective forward and rear grooves 253, 252 and contact an inner surface 125 of the nut socket 123. In various embodiments, the projecting spring and ring traverse a gap 331 between the socket and one or more surfaces of the body base discussed further below. As skilled artisans will appreciate, the nut socket 123 rotates with the nut such that when the nut rotates relative to the body 250 there is relative motion between two or more of the socket, the spring, the O-Ring, and the body base. In various embodiments, there is relative motion between the socket and the spring and between the socket and the O-Ring.

Figure 3B:
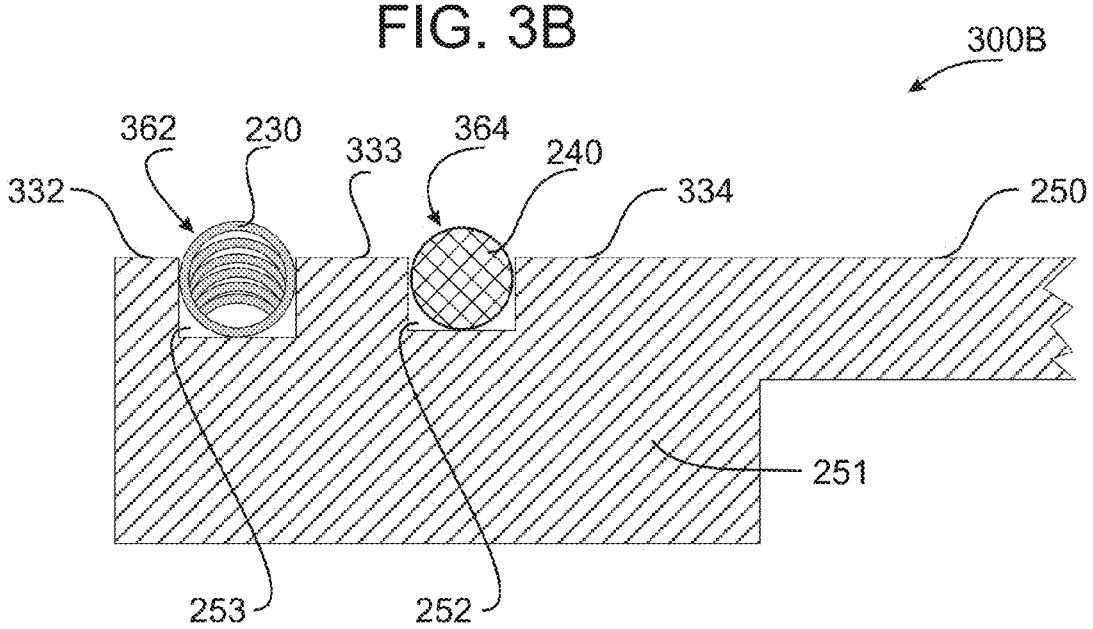
FIGS. 3B-D show enlarged cross-sectional views of alternative body portions for use with the connector of FIG. 1A above.

FIG. 3B shows a portion of the body of the connector of FIG. 3A 300B. In particular, the body 250 base 251 is shown. As mentioned above, the spring 230 and the ring 240 project from the body base grooves 253, 252 and contact an inside surface 125 of the nut 120 socket 123. As seen, body surface portions flank each of the spring projection 362 and the ring projection 364.

In particular, the spring projection 362 is flanked by body surfaces 332 and 333 while the ring projection 364 is flanked by body surfaces 333 and 334. The body surfaces are, in varioous embodiments, cylindrical faces spaced apart from a cylindrical boundary formed by the inside surface 125 of the socket 123. In various embodiments the spaced apart parts form a gap 331 with a consistent measure. And, in various embodiments the spaced apart parts form a gap 331 with a varying measure; for example, an arrangement tending to cooperate in biasing the nut in an axial direction along the connector longitudinal axis and in a radial direction perpendicular to the connector longitudinal axis.

Figure 3C:
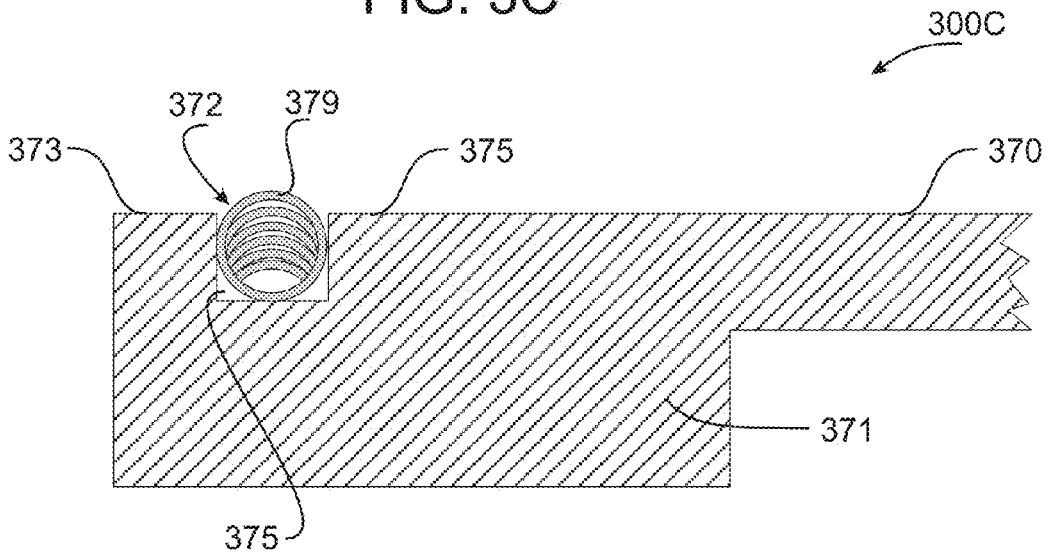

FIG. 3C shows an alternative connector body 300C. In this alternative connector body 370, the body base 371 has a single ring groove. For example, a spring groove 375 is for seating a spring 379 that is flanked by body surfaces 373, 375 which are, in various embodiments, cylindrical faces spaced apart from a cylindrical boundary formed by the inside surface 125 of the socket 123. In various embodiments the spaced apart parts form a gap 331 with a consistent measure. And, in various embodiments the spaced apart parts from a gap 331 with a varying measure; for example, an arrangement tending to cooperate in biasing the nut in an axial direction along the connector longitudinal axis and in a radial direction perpendicular to the connector longitudinal axis. As skilled artisans will understand, a ring such as an O-Ring seal may be located elsewhere in the connector to achieve a similar sealing effect.

Figure 3D:
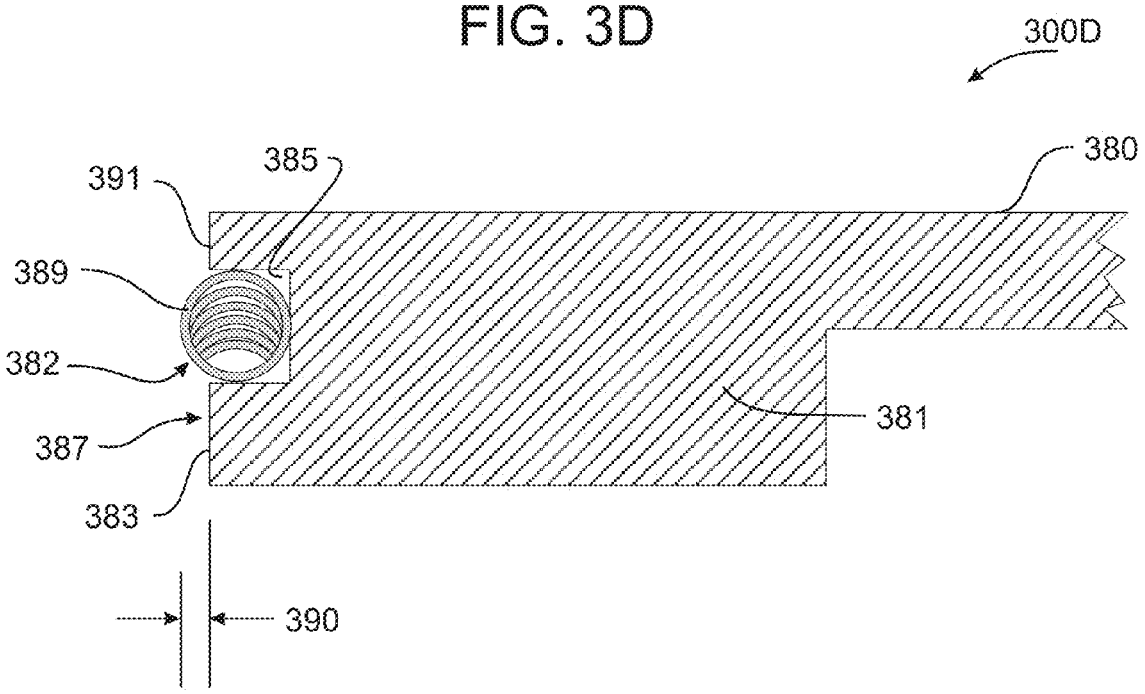

FIG. 3D shows an alternative connector body 300D. In this alternative connector body 380, the body base 381 has no spring groove and no ring groove in the body's cylindrical periphery. Rather, embodiments provide a single spring groove 385 formed in the base 381 end face 387. A spring 389 seated in the groove flanked by annular face surfaces 391, 383. A portion of the spring projecting from the groove 382 traverses a gap 390 to contact an internal annular nut face 129. In various embodiments the spaced apart parts form a gap 390 with a consistent measure. And, in various embodiments the spaced apart parts from a gap 390 with a varying measure.

Various embodiments of the invention provide an electrically conductive spring 230, 379, 389 such as a coil spring 230 that is seated in a body 250 groove 252, 253, 375, 385. Spring projections 362, 372, 382 that contact an electrically conductive nut electrically interconnect the nut with an electrically conductive body such that an electrical circuit is created between the nut and the outer conductor of a coaxial cable engaging an electrically conductive post 220. When the nut engages a mating female connector, this electrical circuit extends from a female connector mating portion, such as metal portion with external threads, to the outer conductor of the coaxial cable that engages the post. As such, embodiments of the present invention provide reliable electrical continuity along a signal ground path established when coaxial cable connectors are mated. And, as skilled artisans will understand, this signal ground path enhances the reliability of signal transport through mated coaxial connectors, even when the male and female connectors are not tightly interengaged.

Figure 4A:
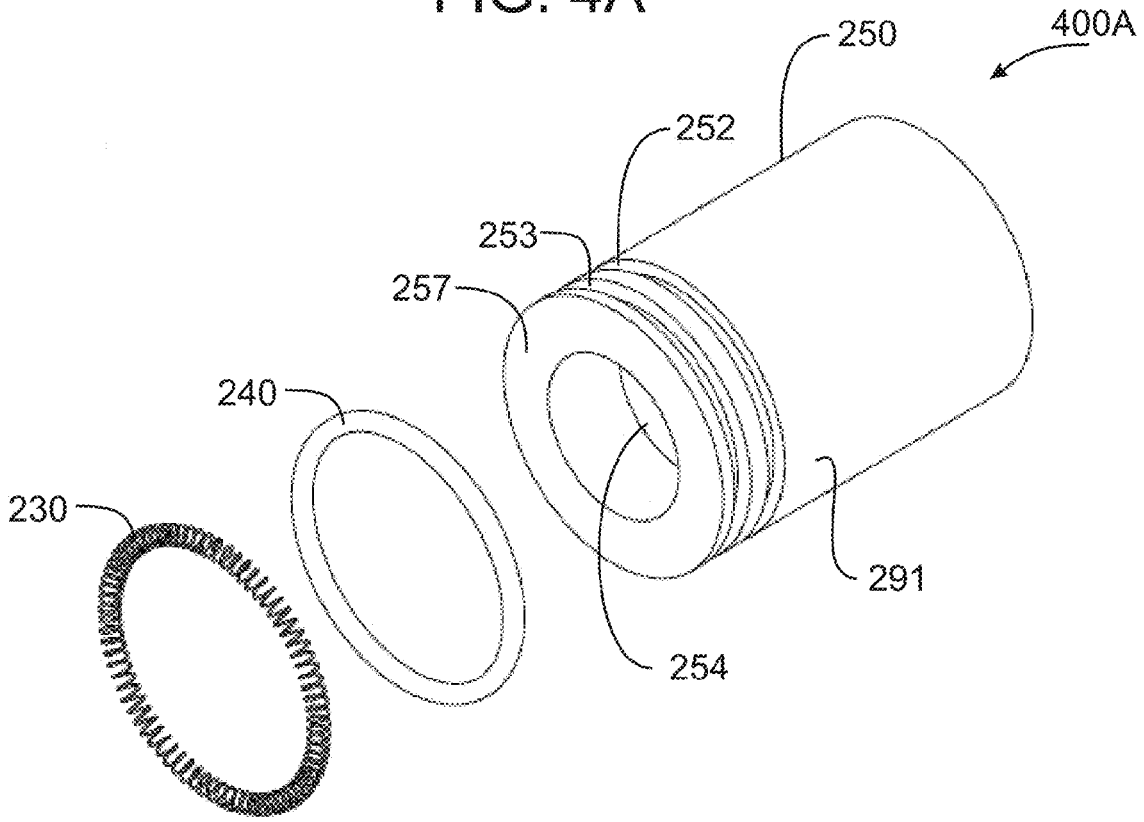
FIG. 4A shows an exploded view of a body assembly of the connector of FIG. 1A above.

FIG. 4A shows a exploded diagram of a connector body with selected fitments 400A. In particular, a connector body 250 with a central through hole 254 defines an annular end face 257. Adjacent forward 253 and rear 252 grooves in an external cylindrical surface 291 of the body provide a means for seating selected body fitments. As shown in the figure, a ring element 240 is for fitment to the rear groove 252 and a spring element such as a coil spring element 230 is for fitment to the forward groove 253. Notably, embodiments of the connector body provide a rigid unitary structure while embodiments of the spring and ring provide elements that can be seated in the grooves via one or more of extension and/or means for interengaging opposing ends of a generally linear structure that may not be extensible.

Figure 4B:
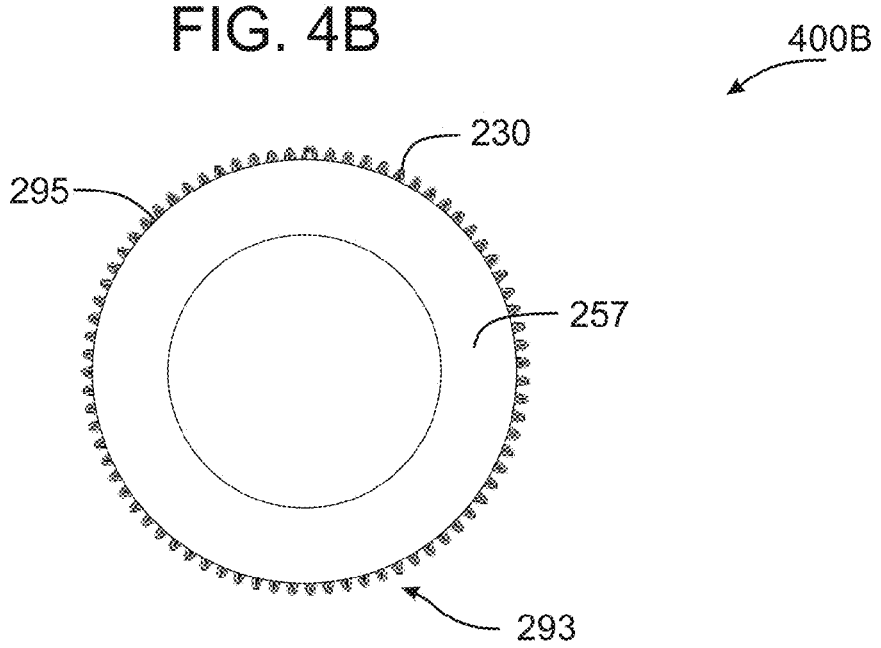
FIG. 4B shows an end view of the assembly of FIG. 4A.

FIG. 4B shows an end view of the body and spring of FIG. 4A 400B. This end view exposes the body annular end face 257. Here, the coil spring 230 is shown seated in a body groove such as the front body groove 253. Around a periphery of the body 295 a portion of the spring 293 is seen to project from the groove. It is noted that such body end face views provide visual descriptions of the spring and its relationship to the groove. In particular, to the extent the spring projects from the body groove this feature is shown.

As seen above, a spring such as a coil spring 230 can be usefully located between the body 250 and the nut 120. Embodiments above include ones placing a spring in a connector body groove 252, 253. FIGS. 5A-J and 6A-G below depict embodiments including a spring extending at least partially around a circumference of a connector body.

Figure 5A:
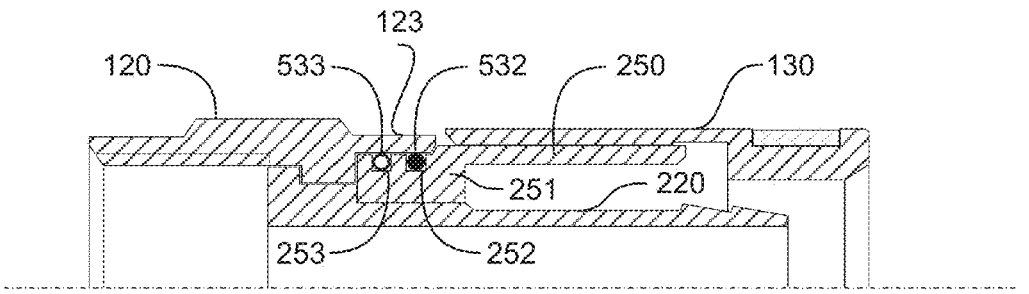
FIG. 5A shows a cross-sectional view illustrating a first group for use with connectors similar to the connector of FIG. 1A above.

FIG. 5A shows a partial cross section of a connector in accordance with the present invention 500A. A connector post 220 rotatably engages a connector coupling such as a nut 120 and a connector body 250 is tightly coupled to the post. While the end cap 130 is shown slidably engaging the body, no coaxial cable and no cable fixation, such as a dual diameter seal, are shown for clarity.

Circumferential grooves 252, 253 in the connector body base 251 are provided to seat inserts 533, 532 at least partially therein such that embodiments provide for contact between each insert and the nut 120, as at the nut socket 123. In various embodiments, one insert is a spring and in various embodiments another insert is a spring or a seal.

Figure 5B:
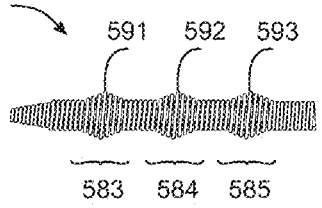
FIGS. 5B-D show endless continuity springs for use with the connector of FIG. 5A above.
Figure 5C:
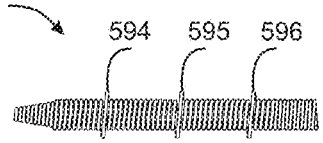
Figure 5D:
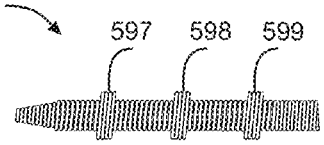
Figure 5E:
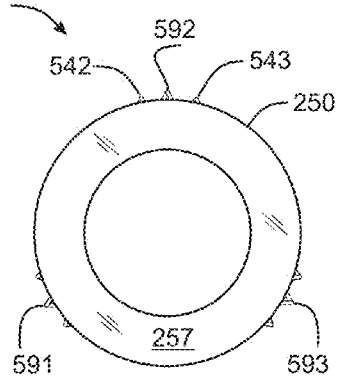
FIGS. 5E-G show end views of body assemblies for use with the connector of FIG. 5A above.
Figure 5F:
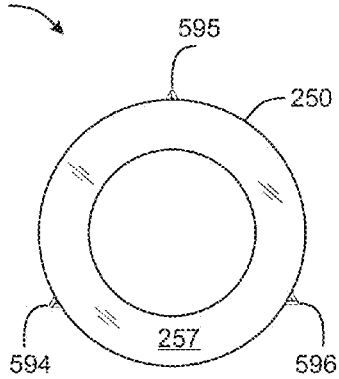
Figure 5G:
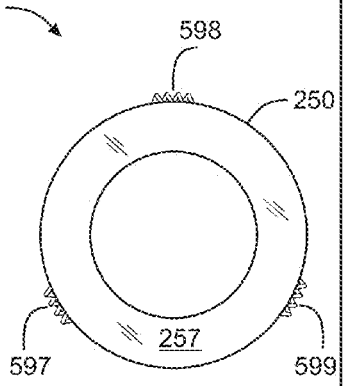
Figure 5H:
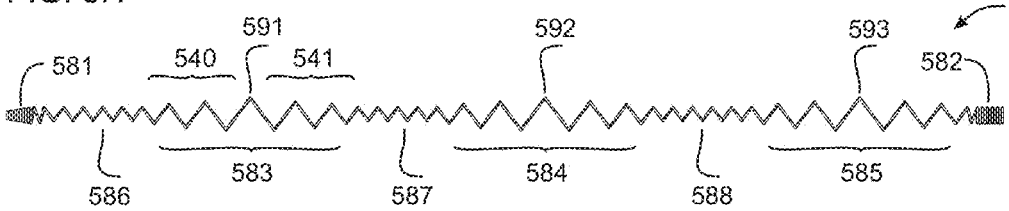
FIGS. 5H-J show endless continuity springs for use with the connector of FIG. 5A above.

FIGS. 5B, 5E, 5H show a first endless spring insert 500B, 500E, 500H. In particular, FIG. 5B shows a spring 500B, FIG. 5E shows an end view of the spring and a body 500E, and FIG. 5H shows the spring elongated 500H.

FIG. 5B shows the first endless spring 500B before its ends are interengaged to form an endless spring. The spring is a coil format spring with one or more large diameter peaks. As shown, the spring has three contact zones or regions 583, 584, 585 and each contact zone includes a respective peak 591, 592, 593.

FIG. 5E shows the first endless spring encircling the body when its ends are interengaged 500E. The figure shows body end face 257 and the first endless spring 500B seated in a groove 252, 253 of the body 250. As seen, spring coils that are spring peaks 591, 592, 593 project from the groove. In some embodiments one or more peak flanking coils 542, 543 also project from the groove.

FIG. 5H shows the first endless spring in an elongated condition 500H. As seen, the spring has end to end fastening means such as pin 581 and socket 582 means for interengaging opposing ends to form an endless spring. As skilled artisans will understand, other than pin and socket means may be used to fashion endless springs. For example, welding, continuous loop fabrication, and other means such as other mechanical means may be used to fashion endless springs in one or more embodiments of the present invention.

The embodiment shown has three peaks 591, 592, 593 in respective contact regions 583, 584, 585 such that the pin and first contact region are coupled by a first spring root region 586, the first contact region and the second contact region are coupled by a second spring root region 587, and the second contact region and the third contact region are coupled by a third spring root region 588. As shown, the peaks of the contact regions are flanked by spring coil(s) of increasing diameter in an entry zone 540 and flanked by spring coil(s) of decreasing diameter in an exit zone 541.

Figure 5I:
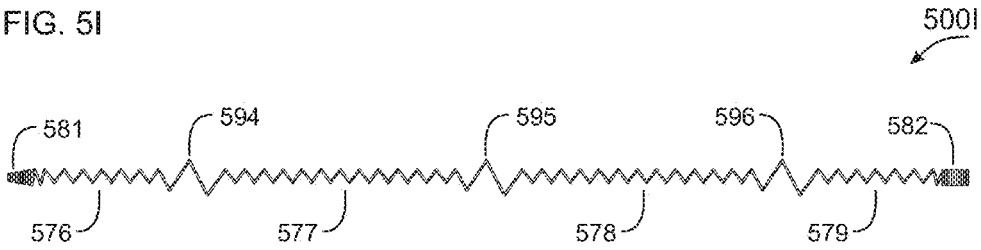

FIGS. 5C, 5F, 5I show a second endless spring insert 500C, 500F, 500I. In particular, FIG. 5C shows a spring 500C, FIG. 5F shows an end view of the spring and a body 500F, and FIG. 5I shows the spring elongated 500I.

FIG. 5C shows the second endless spring 500C before its ends are interengaged to form an endless spring. The spring is a coil format spring with one or more large diameter peaks. As shown, the spring has three large diameter peaks 594, 595, 596.

FIG. 5F shows the second endless spring encircling the body when its ends are interengaged 500F. The figure shows body end face 257 and the second endless spring 500C seated in a groove 252, 253 of the body 250. As seen, spring coils that are spring peaks 594, 595, 596 project from the groove.

FIG. 5I shows the second endless spring in an elongated condition 500I. As seen, the spring has end to end fastening means such as pin 581 and socket 582 means for interengaging opposing ends to form an endless spring. The embodiment shown has three peaks 594, 595, 596. The pin and first peak are coupled by a first spring root region 576, the first and second peaks are coupled by a second spring root region 577, the second and third peaks are coupled by a third spring root region 578, and the third peak and socket 582 are coupled by a fourth spring root region 579.

Figure 5J:
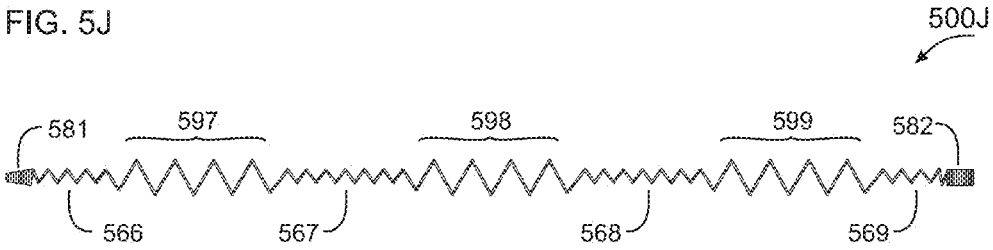

FIGS. 5D, 5G, 5J show a third endless spring insert 500D, 500G, 500J. In particular, FIG. 5D shows a spring 500D, FIG. 5G shows an end view of the spring and a body 500G, and FIG. 5J shows the spring elongated 500J.

FIG. 5D shows the third endless spring 500D before its ends are interengaged to form an endless spring. The spring is a coil format spring with one or more groups of large diameter peaks. As shown, the spring has three groups of contact peaks 597, 598, 599.

FIG. 5G. shows the third endless spring encircling the body when its ends are interengaged 500G. The figure shows body end face 257 and the third endless spring 500D seated in a groove 252, 253 of the body 250. As seen, spring coils of spring peak groups 597, 598 599 project from the groove.

FIG. 5J shows the third endless spring in an elongated condition 500J. As seen, the spring has end to end fastening means such as pin 581 and socket 582 means for interengaging opposing ends to form an endless spring. The embodiment shown has three groups of peaks 597, 598, 599 such that the pin and first group of peaks are coupled by a first spring root region 566, the first group of peaks and the second group of peaks are coupled by a second spring root region 567, the second group of peaks and the third group of peaks are coupled by a third spring root region 568, and the third group of peaks and the socket are coupled by a fourth spring root region 569.

Insert materials such as spring materials include any of those known by skilled artisans to be suitable including resilient electrical conductors. Useful metals and/or their alloys include iron, steel, copper, nickel, beryllium, and the like. In an embodiment, the spring is made from a stainless steel and in an embodiment the spring is made from an alloy comprising beryllium and/or copper. In some embodiments, the spring is coated as with gold or another material which may be selected to reduce rubbing friction between the spring and a contacting part such as a coupling. Various embodiments provide an insert that electrically couples the nut and the body.

Figure 6A:
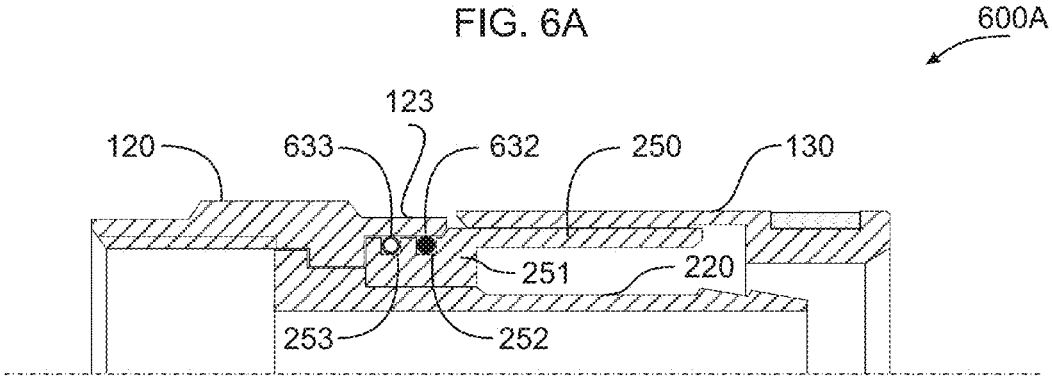
FIG. 6A shows a cross-sectional view illustrating a second group of connectors similar to the connector of FIG. 1A above.

FIG. 6A shows a partial cross section of a connector in accordance with the present invention 600A. A connector post 220 rotatably engages a connector coupling such as a nut 120 and a connector body 250 is tightly coupled to the post. While the end cap 130 is shown slidably engaging the body, no coaxial cable and cable fixation such as a dual diameter seal is shown for clarity.

Circumferential grooves 252, 253 in the connector body base 251 are provided to seat inserts 633, 632 at least partially therein such that embodiments provide for contact between each insert and the nut 120 as at the nut socket 123. In various embodiments, one insert is a spring and in various embodiments another insert is a spring or a seal such as an O-Ring seal.

Figure 6B:
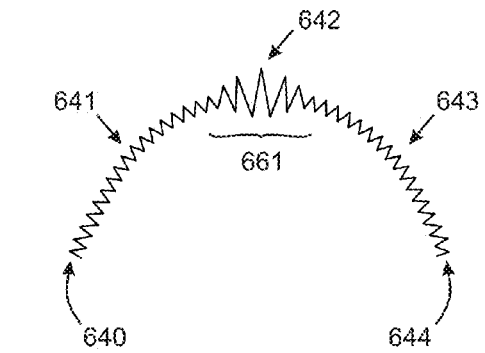
FIGS. 6B-C show non-endless continuity springs for use with the connector of FIG. 6A above.
Figure 6C:
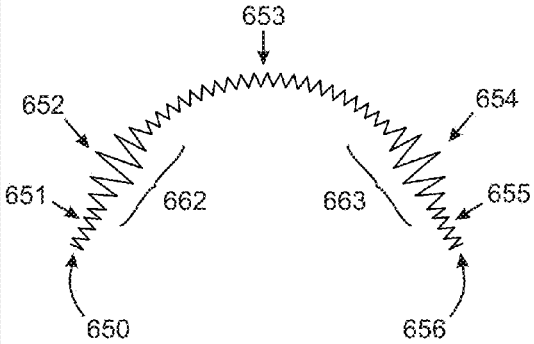
Figure 6D:
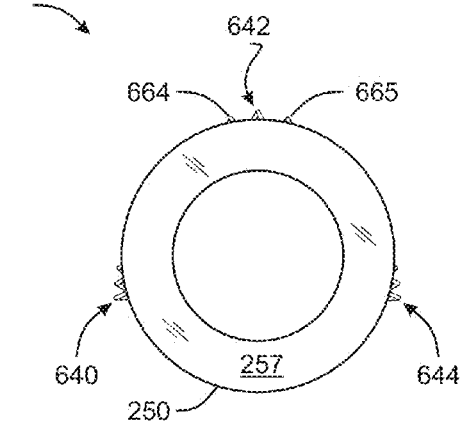
FIGS. 6D-E show end views of body assemblies for use with the connector of FIG. 6A above.
Figure 6E:
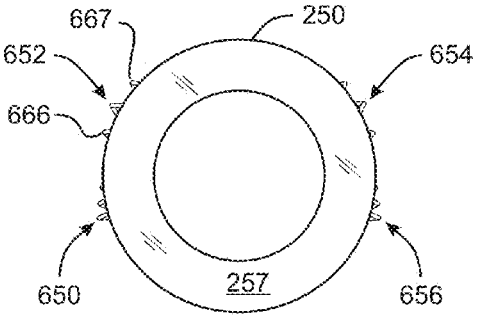
Figure 6F:
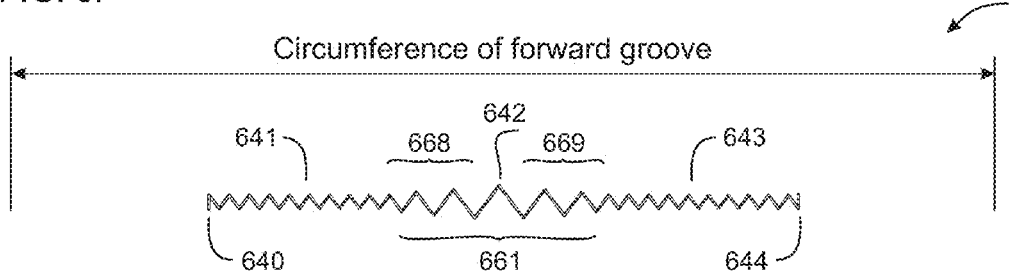
FIGS. 6F-G show non-endless continuity springs for use with the connector of FIG. 6A above.

FIGS. 6B, 6D, 6F show a first open loop spring insert 600B, 600D, 600F. In particular, FIG. 6B shows a spring 600B, FIG. 6D shows an end view of the spring and a body 600D, and FIG. 6F shows the spring elongated 600F.

FIG. 6B shows the first open loop spring 600B. The spring is a coil format spring with one or more large diameter peaks. As shown, the spring has one contact zone 661 that includes a peak formed by a large diameter spring coil 642.

FIG. 6D shows the first open loop spring partially encircling the body 600D. The figure shows body end face 257 and the first open loop spring 600B seated in a groove 252, 253 of the body 250. As seen, a relatively larger spring coil (see also description below) forms a peak 642 that projects from the groove. In some embodiments one or more peak flanking coils 664, 665 also project from the groove.

In various embodiments, open loop spring ends 640, 644 project from the groove 252, 253 of the body. As shown in FIG. 6D, one or more spring coils at each end of the spring project from the groove.

FIG. 6F shows the first open loop spring in an elongated condition 600F. As seen, the spring has free ends 640, 644. The embodiment shown has one peak 642 in one contact region 661 such that the first free end 640 and the contact region are coupled by a first spring root region 641 and the first contact region and the second free end 644 are coupled by a second spring root region 643. As shown, the peak of the contact region is flanked by spring coil(s) of increasing diameter in an entry zone 668 and flanked by spring coil(s) of decreasing diameter in an exit zone 669.

Figure 6G:
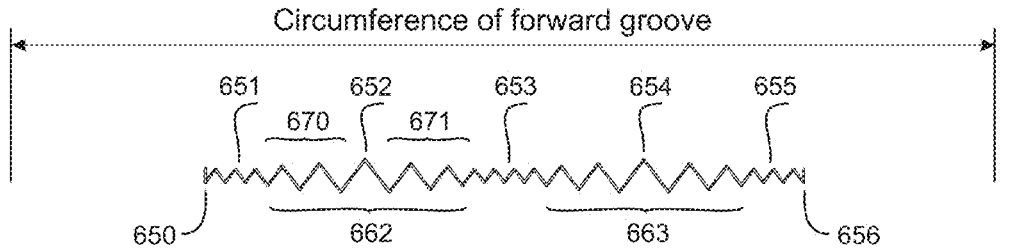

FIGS. 6C, 6E, 6G show a second open loop spring insert 600C, 600E, 600G. In particular, FIG. 6C shows a spring 600C, FIG. 6E shows an end view of the spring and a body 600E, and FIG. 6G shows the spring elongated 600G.

FIG. 6C shows the second open loop spring 600C. The spring is a coil format spring with one or more large diameter peaks. As shown, the spring has two contact zones 662, 663 that include respective peaks 652, 654 formed, for example, by large diameter spring coils.

FIG. 6E. shows the second open loop spring partially encircling the body 600E. The figure shows body end face 257 and the second open loop spring 600C seated in a groove 252, 253 of the body 250. As seen, relatively larger spring coils (see also description below) form respective peaks 652, 654 that project from the groove. In some embodiments one or more peak flanking coils 666, 667 also project from the groove.

In various embodiments, open loop spring ends 650, 656 project from the groove 252, 253 of the body. As shown in FIG. 6E, one or more spring coils at each end of the spring project from the groove.

FIG. 6G shows the second open loop spring in an elongated condition 600G. As seen, the spring has free ends 650, 656. The embodiment shown has two peaks 652, 654 and respective contact regions 662, 663 such that the first free end 650 and the first contact region are coupled by a first spring root region 651, the first contact region and the second contact region are coupled by a second spring root region 653, and the second contact region and second free end are coupled by a third spring root region 655. As shown, the peaks of the contact regions may be flanked by spring coil(s) of increasing diameter such as shown in an exemplary entry zone 670 and flanked by spring coil(s) of decreasing diameter such as shown in an exemplary exit zone 671.

In some embodiments, the connector body grooves do not traverse a full circle. Rather, their traverse is an open loop. Here, inserts are again open loop inserts and include suitable ones of those mentioned above. As skilled artisans will understand, open loop grooves will be shorter than corresponding closed loop grooves and therefore open loop groove inserts will be length limited by comparison.

Insert materials such as spring materials include any of those known by skilled artisans to be suitable including resilient electrical conductors. Useful metals and/or their alloys include iron, steel, copper, nickel, beryllium, and the like. In an embodiment, the spring is made from a stainless steel and in an embodiment the spring is made from an alloy comprising beryllium and/or copper. In some embodiments, the spring is coated as with gold or another material which may be selected to reduce rubbing friction between the spring and a contacting part such as a coupling. Various embodiments provide an insert that electrically couples the nut and the body.

Figure 7A:
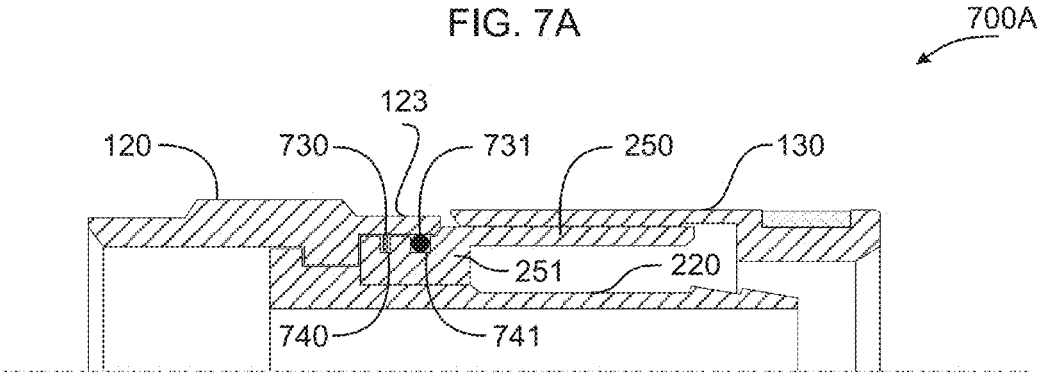
FIG. 7A shows a cross-sectional view illustrating a third connector group similar to the connector of FIG. 1A above.

FIG. 7A shows a partial cross section of a connector in accordance with the present invention 700A. A connector post 220 rotatably engages a connector coupling such as a nut 120 and a connector body 250 is tightly coupled to the post. While the end cap 130 is shown slidably engaging the body, no coaxial cable and no cable fixation, such as a dual diameter seal, are shown for clarity.

Circumferential grooves 740, 741 in the connector body base 251 are provided to seat inserts 730, 731 at least partially therein such that embodiments provide for contact between each insert and the nut 120 as at the nut socket 123. In various embodiments, one insert is a spring and in various embodiments another insert is a spring or a seal such as an O-Ring seal.

Figure 7B:
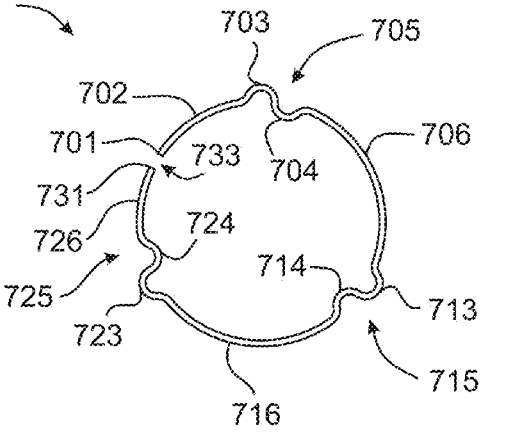
FIGS. 7B-C show elevation and side views of an undulating continuity member for use with the connector of FIG. 7A above.
Figure 7C:
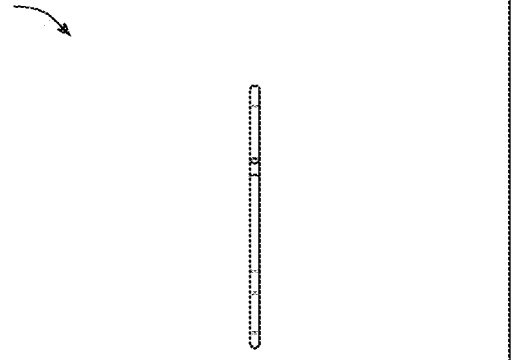

FIGS. 7B, 7C show elevation and side views of an undulating loop spring 700B, 700C. In particular, FIG. 7B shows an elevation view of the spring 700B while FIG. 7C shows a side view of the spring 700C.

Unlike the coil springs mentioned above, the undulating loop spring is a substantially planar spring form describing a single loop that is open in some embodiments. Embodiments of open loop springs resist both increases and decreases in a gap 733 between first and second spring ends 701, 731.

As shown, the spring has three peaks 703, 713, 723 and each peak is adjacent to a respective similarly shaped valley 704, 714, 724. Peak/valley pairs form respective first, second and third contact regions 705, 715, 725 with a first spring root region 706 between the first and second contact regions, a second spring root region 716 between the second and third contact regions. The gap 733 of the open loop spring is flanked by a first spring root section 702 extending from the first contact region and by a second spring root section 726 extending from the third contact region.

Figure 7D:
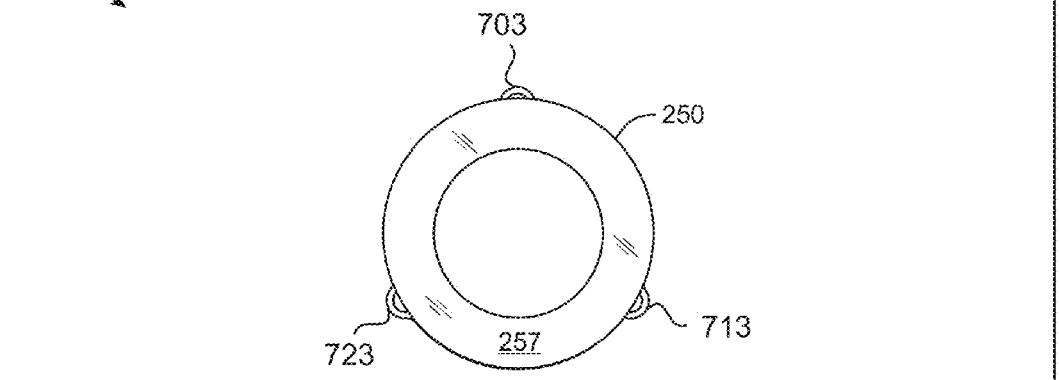
FIG. 7D shows an end views of a body assembly for use with the connector of FIG. 7A above.

FIG. 7D. shows the first undulating loop spring partially encircling the body 700D. The figure shows body end face 257 and the first open loop spring 700B seated in a groove 740, 741 of the body 250. As seen, the spring peaks 703, 713, 723 project from the groove. In various embodiments, one or more contact groups provide one or more respective projections from the groove. Notably, the springs described above may be seated in body 250 base 251 grooves of varying cross section. In some embodiments, a groove is configured to accommodate planar and/or torsional action of the spring.

In various embodiments, the undulating loop spring 700B, 700C is replaced by another resilient member. For example, alternatives include a washer like retaining ring and an undulating band.

Insert materials such as spring materials include any of those known by skilled artisans to be suitable including resilient electrical conductors. Useful metals and/or their alloys include iron, steel, copper, nickel, beryllium, and the like. In an embodiment, the spring is made from a stainless steel and in an embodiment the spring is made from an alloy comprising beryllium and/or copper. In some embodiments, the spring is coated as with gold or another material which may be selected to reduce rubbing friction between the spring and a contacting part such as a coupling. Various embodiments provide an insert that electrically couples the nut and the body.

FIGS. 8A-D show body base grooves of varying cross section 800A-D. As skilled artisans will understand, springs may conform to the one or more of the groove cross sections or springs may have discrete contact points with the groove. In particular, coil spring embodiments having other than circular loops may be accommodated by embodiments of the grooves described below.

Figure 8A:
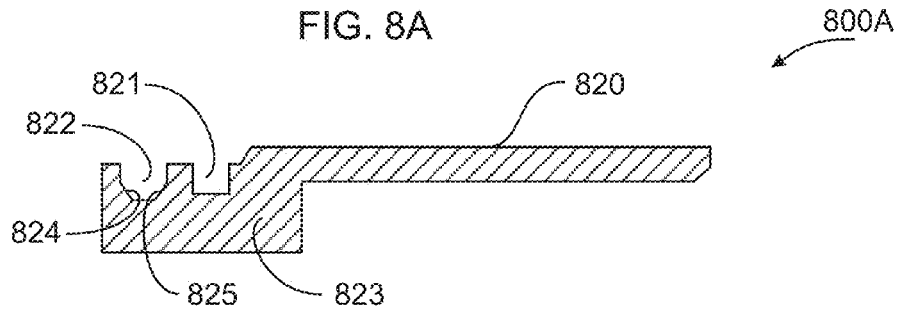
FIGS. 8A-D show partial cross-sections of alternative body members for use with selected connectors similar to the connector of FIG. 1A above.

FIG. 8A shows a first groove configuration 800A. A body 820 includes a body base 823. The body base includes rear and forward grooves 821, 822. A rectangle or square describes the cross section of the rear groove. Similar to the rear groove, the front groove has chamfered internal corners 824, 825.

Figure 8B:
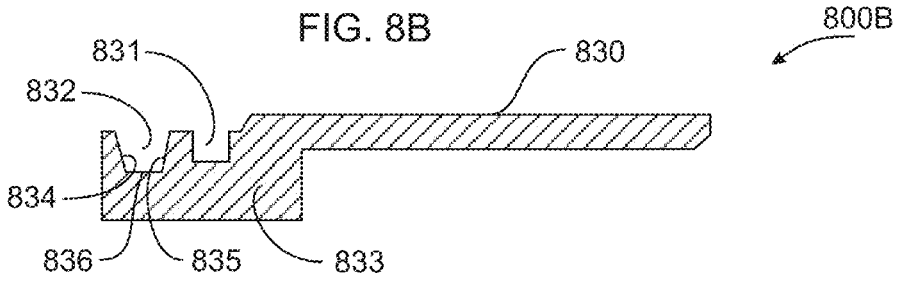

FIG. 8B shows a second groove configuration 800B. A body 830 includes a body base 833. The body base includes rear and forward grooves 831, 832. A rectangle or square describes the cross section of the rear groove. Sloped sidewalls 834, 835 and a flat bottom 836 describe the cross section of the forward groove.

Figure 8C:
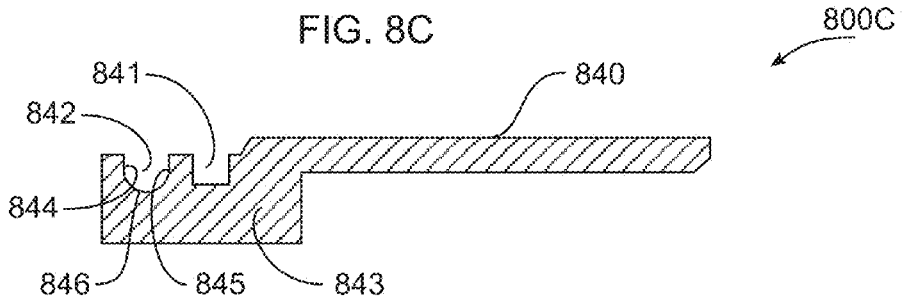

FIG. 8C shows a third groove configuration 800C. A body 840 includes a body base 843. The body base includes rear and forward grooves 841, 842. A rectangle or square describes the cross section of the rear groove. Vertical sidewalls 844, 845 and a rounded bottom 846 describe the cross section of the forward groove.

Figure 8D:
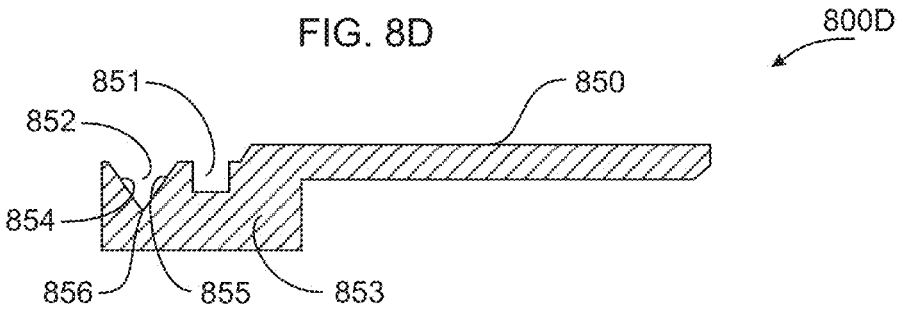

FIG. 8D shows a fourth groove configuration 800D. A body 850 includes a body base 853. The body base includes rear and forward grooves 851, 852. A rectangle or square describes the cross section of the rear groove. Sidewalls 854, 855 sloped to form a "V" shape with a vertex 856 describe the cross section of the forward groove.

While various embodiments of the present invention have been described above, it should be understood that they have been presented by way of example only, and not limitation. It will be apparent to those skilled in the art that various changes in the form and details can be made without departing from the spirit and scope of the invention. As such, the breadth and scope of the present invention should not be limited by the above-described exemplary embodiments, but should be defined only in accordance with the following claims and equivalents thereof.

What is claimed is:

1. A coaxial cable connector comprising:

a coupling having a forward mouth and a trailing socket;

a body coaxially arranged with respect to the coupling;

the body having a base and a groove in a periphery of the base;

a coil spring seated in the groove of the base and the base inserted in the socket of the coupling;

the base and a socket interior surface spaced apart and defining a circumferential gap;

the spring having at least one peak including a coil of a peak diameter;

flanking spring portions to either side of the peak;

the flanking spring portions having coils of one or more diameters no one of which is as large as the peak diameter;

spring coils adjacent to the peak diameter coil contained within the groove; and, the peak diameter coil extending from the groove and contacting the socket interior surface.

2. The coaxial cable connector of claim 1 further comprising:

first and second spring coil ends and a gap therebetween.

3. The coaxial cable connector of claim 1 further comprising:

an absence of spring coil ends.

4. A coaxial cable connector comprising:

a tubular post rotatably engaging a nut and fixedly engaging a coaxially arranged body at a body collar;

on a body radial periphery opposite the body collar, a body groove;

a nut shroud overhanging the body groove and creating a radial gap therebetween;

a coil spring in the body groove;

the coil spring having at least one contacting coil that extends across the gap and contacts the shroud;

the coil spring including root coil sections to either side of the contacting coil; and, the root coil sections do not extend across the gap.

5. The coaxial cable connector of claim 4 wherein the coil spring electrically couples the nut and the body.

6. The coaxial cable connector of claim 4 further comprising:

first and second spring coil ends and a gap therebetween.

7. The coaxial cable connector of claim 6 further comprising:

an absence of spring coil ends.

8. A coaxial cable connector comprising:

a tubular body having a circumferential groove in an exterior surface near one end of the body;

a coupling having a forward mouth and a trailing shroud;

the coupling rotatably coupled with the tubular body;

the shroud encircling the groove and forming a circumferential gap between the body and the shroud;

a substantially planar undulating loop spring seated in the groove; and, one or more spring peaks projecting from the groove and across the gap to contact the shroud.

* * * * *